US008109367B2

(12) United States Patent
Ach

(10) Patent No.: US 8,109,367 B2
(45) Date of Patent: Feb. 7, 2012

(54) COUNTERWEIGHT AND SUSPENSION FOR AN ELEVATOR WITHOUT AN ENGINE ROOM

(75) Inventor: Ernst Ach, Ebikon (CH)

(73) Assignee: Inventio AG, Hergiswil NW (CH)

( * ) Notice: Subject to any disclaimer, the term of this patent is extended or adjusted under 35 U.S.C. 154(b) by 228 days.

(21) Appl. No.: 11/761,503

(22) Filed: Jun. 12, 2007

(65) Prior Publication Data

US 2007/0289821 A1 Dec. 20, 2007

(30) Foreign Application Priority Data

Jun. 14, 2006 (EP) ..... 06115448

(51) Int. Cl.
*B66B 11/08* (2006.01)
*B66B 17/12* (2006.01)
*B66B 7/06* (2006.01)

(52) U.S. Cl. ..... 187/266; 187/404

(58) Field of Classification Search ..... 187/254, 187/249, 404, 405, 266; *B66B 17/12, 7/06, B66B 9/00, 11/08*
See application file for complete search history.

(56) References Cited

U.S. PATENT DOCUMENTS 789,911 A * 5/1905 Aker ..... 65/182.4
RE18,095 E * 6/1931 Sprague ..... 187/249
1,896,776 A * 2/1933 James ..... 187/249
5,435,417 A * 7/1995 Hakala ..... 187/404
5,469,937 A * 11/1995 Hakala et al. ..... 187/266
5,566,785 A * 10/1996 Hakala ..... 187/250
5,573,084 A * 11/1996 Hakala ..... 187/252
6,302,239 B1 * 10/2001 Honda ..... 187/254
6,601,828 B2 * 8/2003 Strbuncelj et al. ..... 254/266
6,619,433 B1 * 9/2003 Robert et al. ..... 187/251
2004/0216958 A1 * 11/2004 Ach ..... 187/254
2004/0216959 A1 * 11/2004 Ach ..... 187/264
2005/0087397 A1 * 4/2005 Faletto ..... 187/254

FOREIGN PATENT DOCUMENTS

EP 1574472 A2 * 9/2005
EP 1 602 613 A 12/2005
JP 09040322 A * 2/1997
WO WO 99/43592 A 9/1999
WO WO 03/042089 5/2003

* cited by examiner

*Primary Examiner* — Michael Mansen
*Assistant Examiner* — Stefan Kruer
(74) *Attorney, Agent, or Firm* — Fraser Clemens Martin & Miller LLC; William J. Clemens

(57) ABSTRACT

In an elevator, with an elevator car, a counterweight, a drive unit arranged below the counterweight and provided with a drive pulley, and an elevator support device, which is guided over the drive pulley and at least one deflecting pulley and which supports and moves the elevator car and the counterweight in opposite directions, at least one run of the support device, which leads to the drive pulley, is led through a cut-out in the counterweight.

20 Claims, 2 Drawing Sheets

Section III-III

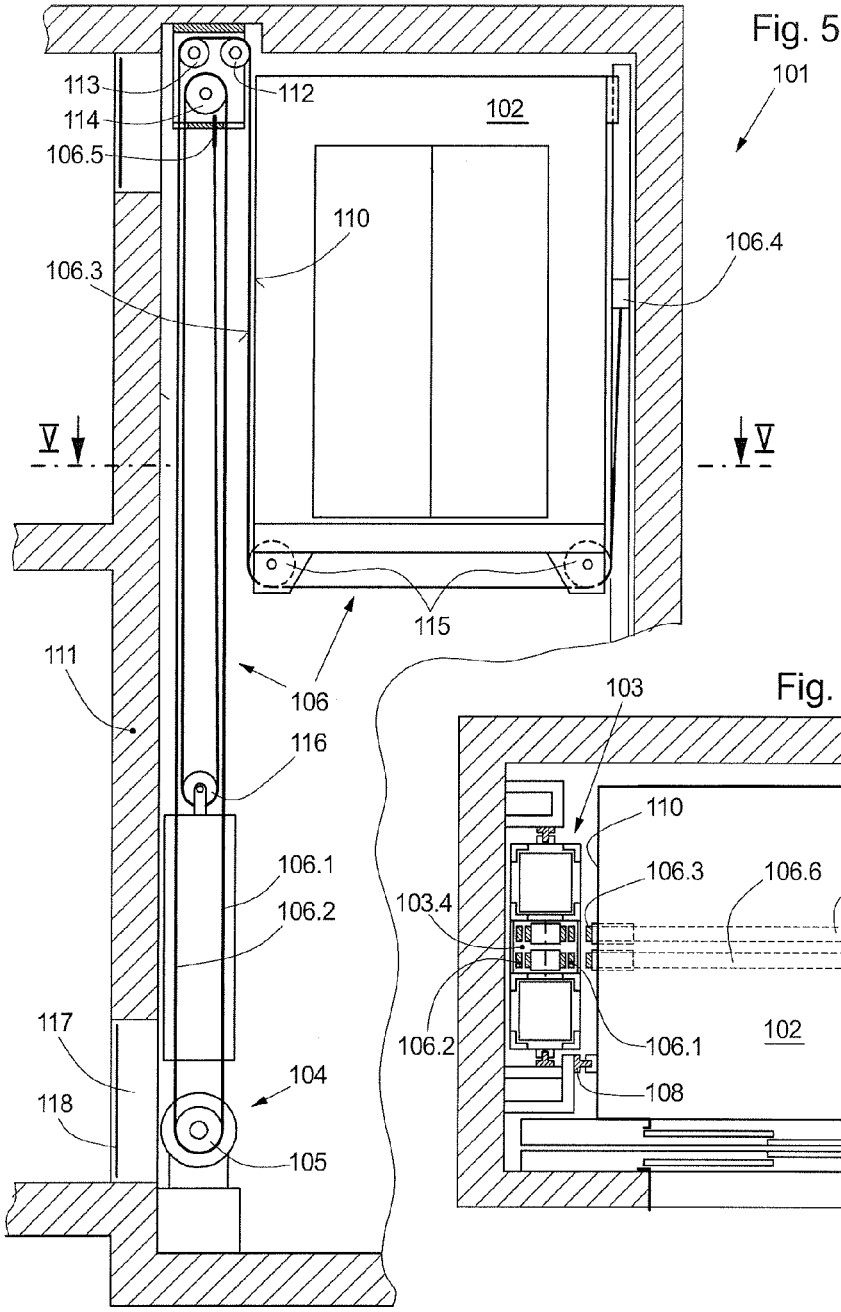
Fig. 5
101
113
112
114
102
106.5
110
106.4
106.3
V
V
115
111
106
116
106.1
106.2
117
104
118
105
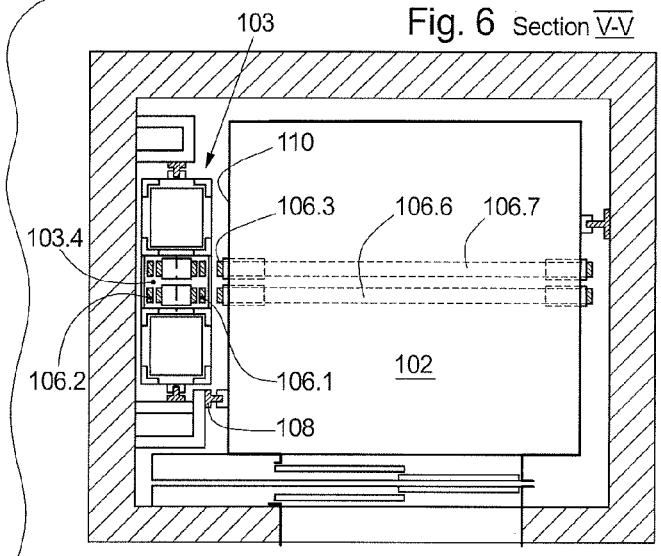
Fig. 6 Section V-V
103
110
106.3
106.6
106.7
103.4
106.2
106.1
102
108
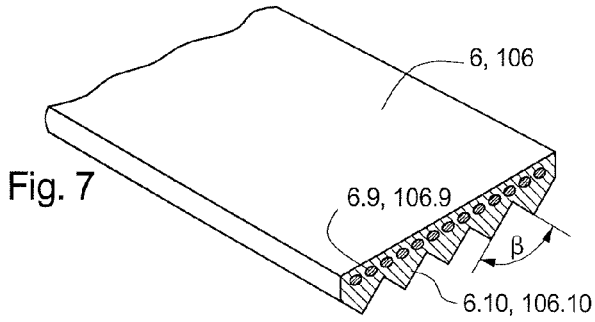
Fig. 7
6, 106
6.9, 106.9
β
6.10, 106.10

COUNTERWEIGHT AND SUSPENSION FOR AN ELEVATOR WITHOUT AN ENGINE ROOM

FIELD OF THE INVENTION

This invention relates to an elevator with an elevator car, a counterweight and a drive unit provided with at least one drive pulley and arranged below the counterweight disposed in a lowermost position, wherein an elevator support means guided over the drive pulley and at least one deflecting pulley supports the elevator car and the counterweight and moves them in opposite sense direction) when the drive pulley of the drive unit drives the elevator support means.

BACKGROUND OF THE INVENTION

A drive pulley elevator with an elevator car, a counterweight and a drive unit installed below the travel path of the counterweight is known from U.S. Pat. No. 5,469,937, in which the drive unit is so constructed and arranged that it substantially does not project beyond the side surfaces, which are parallel to the shaft wall at the counterweight side, of the counterweight. It is thus achieved that the elevator car, measured at right angles to the shaft wall at the counterweight side, can have a largest possible width and in that case can move past the drive unit without an installation space for the drive unit outside the shaft cross-section being necessary.

An elevator installation constructed in accordance with the teaching according to U.S. Pat. No. 5,469,937 has the disadvantage that the runs, which extend from the drive pulley of the drive unit to deflecting pulleys present in the shaft head, of the elevator support means have to be led laterally past the counterweight. The outer diameter of the drive pulley therefore has to be greater than the width of the counterweight measured parallel to the shaft wall at the counterweight side. Since a greater drive pulley diameter requires a greater torque of the drive motor and thus also larger motor dimensions, relatively tight limits are imposed on the drive pulley diameter and thus the mentioned width of the counterweight. The length of the counterweight in modern elevator installations is similarly strongly limited by the smallest possible shaft head heights and shaft pit depths, since the travel path length available for the counterweight is reduced by the drive unit mounted below the counterweight. The required mass of the counterweight can thus only still be achieved by increase in the thickness—measured at right angles to the shaft wall at the counterweight side—of the counterweight. Since modern elevator drives, thanks to highly flexible support means, work with very small drive pulley diameters and thereby with extremely small motor dimensions, the thickness of the counterweight in the case of the conditions described in the foregoing usually exceeds the size of the drive unit measured in the direction of this thickness, so that an optimum width, which corresponds with the given shaft cross-section and the given size of the drive unit, of the elevator car cannot be realized.

SUMMARY OF THE INVENTION

The present invention has the object of creating elevators, without an engine room, of the kind described in the foregoing which do not have the stated disadvantages of the equipment cited as state of the art, the elevator cars of which have a largest possible useful area with drive unit installed below the travel path of the counterweight and with a given cross-section of the elevator shaft, and in which the complexity of the entire drive and also the overall costs of the elevator are kept as small as possible.

According to the present invention at least one of these objects in the case of an elevator without an engine room,

- which comprises a elevator car movable along a car travel path and a counterweight movable along a counterweight travel path arranged laterally of the car travel path,
- in which a drive unit is arranged below the counterweight in the lowermost position thereof and
- in which a elevator support means guided over the drive pulley and at least one deflecting pulley arranged in the shaft head region supports the elevator car and the counterweight and moves them in opposite sense when the drive unit drives the elevator support means by way of the drive pulley, is fulfilled in that at least one of the runs, which is led approximately vertically to the drive pulley, of the elevator support means is led through a cut-out in the counterweight.

The advantages achieved by the present invention are substantially to be seen in that the disadvantages and problems, which are stated in the foregoing, of the elevator cited as state of the art are eliminated. In particular, it is achieved with this that a counterweight of virtually unlimited width can be used, the thickness of which does not exceed the size—measured in the direction of this thickness—of a small drive unit, which enables installation of an elevator car with a useful area of optimum size for a given shaft cross-section. The diameter of the drive pulley is not dependent on the width of the counterweight and can thus be designed as small as the support means permits. Commercially available drive motors with correspondingly low torque and thus small size and lower price can thereby be used.

According to a particularly preferred form of embodiment of the invention the drive unit is so arranged below the counterweight in the lowermost position thereof that the elevator car can move past it. This enables construction of elevator installations with a smallest possible shaft pit depth.

In a particularly economic form of embodiment the axis of the drive pulley and also the axis of the at least one deflecting pulley are arranged parallel to the shaft wall at the counterweight side. Use is thereby made possible of economic, commercially available motors, the length of which is greater than their diameter, as the drive unit. In the stated installation position such a slender drive unit, which is preferably of gearless construction, allows a small spacing between the car wall at the counterweight side and the shaft wall at the counterweight side.

A particularly advantageous development of the present invention consists in that the drive pulley and the at least one deflecting pulley each respectively associated with a support means strand are so arranged that their center pulley planes lie in a common vertical plane. This gives significant advantages for the arrangement of several parallel support cables, which in this arrangement do not have to be twisted about a common axis. Assembly effort and wear are reduced by such a support cable arrangement. Such an arrangement is virtually a precondition for the use of support means, in the manner of a flat belt, with several parallel support means strands.

Advantageously the drive pulley, the at least one deflecting pulley and support means fixing points present in a given case are so arranged that the elevator support means is always bent in the same sense (same side facing) when running around the drive and deflecting pulleys. Resulting from such an arrangement of the support cable or flat-belt-like support means used as elevator support means is a significant increase in the service life thereof.

A high level of capability of adaptation of the elevator according to the present invention to different requirements is given in that the elevator support means together with the drive and deflecting pulleys can form a 1:1 suspension or a 2:1 suspension for the elevator car and the counterweight. In a 1:1 suspension the support means in the region of the drive pulley moves at the same speed as, and in the case of a 2:1 suspension at twice the speed of, the elevator car.

A further advantageous development of the present invention consists in that the elevator support means is constructed in the manner of a flat belt. Such an elevator support means enables use of drive and deflecting pulleys with small diameters and thus correspondingly slender motors of the drive unit. On the one hand the part of the elevator shaft required for installation of the drive unit and lost for installation of the elevator car is smaller and the costs for the drive unit with control means and rotational speed regulating means are substantially reduced.

According to a further preferred development of the present invention the elevator support means in the manner of a flat belt has guide ribs which are oriented in its longitudinal direction and which co-operate with guide grooves of the drive pulley and/or of the deflecting pulley. Such guide means offer a precise and low-wear guidance of the flat-belt-like support means on the drive and deflecting pulleys and can, with suitable shaping, increase the transmissible traction force.

Excellent utilization of the shaft cross-section for the useful area of the elevator car can be achieved with drive and/or deflecting pulleys having outer diameters of less than 100 millimeters.

In a form of embodiment, which is advantageous for the use of flat drive units, of an elevator according to the present invention the axis of the drive pulley is arranged at right angles to the shaft wall at the counterweight side. By a flat drive unit there is to be understood a drive unit of which the length measured in the direction of the drive pulley axis is shorter than its diameter. An elevator with such an arrangement of the drive unit, in which, however, the runs of the elevator support means leading to the drive pulley are not led in accordance with the invention through the counterweight, is disclosed in the U.S. Pat. No. 5,469,937 mentioned above as the state of the art.

According to a preferred form of embodiment of the present invention the drive unit is completely arranged in the shaft space between the car wall at the counterweight side and the shaft wall at the counterweight side. Insofar as the drive unit does not require any more installation space in the direction of the thickness of the counterweight than the counterweight itself a simple and economic form of embodiment of an elevator according to the present invention is thus achieved.

According to a further form of embodiment of the present invention a part of the drive unit protrudes into a niche in the shaft wall at the counterweight side. It is thereby possible to also make use of a drive unit, without losses of useful area of the elevator car, which requires more installation space in the direction of the thickness of the counterweight than the counterweight itself.

Advantageous conditions for maintenance of the drive unit are offered by an embodiment of the present invention in which the shaft wall at the counterweight side has in the region of the drive unit, preferably when a niche is present, a closable maintenance opening which enables at least maintenance, preferably also exchange, of the drive unit from a space lying outside the elevator shaft.

A form of embodiment of the present invention in which the shaft space can be utilized in an optimum manner for the useful area of the elevator car can be achieved by the use of a drive unit with a permanent magnet motor. Permanent magnet motors need, for the same motor length, a smaller motor diameter than usual asynchronous or synchronous three-phase motors for development of a required torque.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 5 is a schematic vertical section through an elevator with an elevator car, a counterweight arranged on the left-hand side of the elevator car and a drive unit disposed at the bottom, wherein the elevator support means forms a 2:1 suspension and two of its runs are led through the counterweight;

FIG. 6 is a horizontal cross-section through the elevator according to FIG. 5; and FIG. 7 is perspective view of a support means of the elevator according to the present invention, in the manner of a flat belt, with guide ribs.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 2:
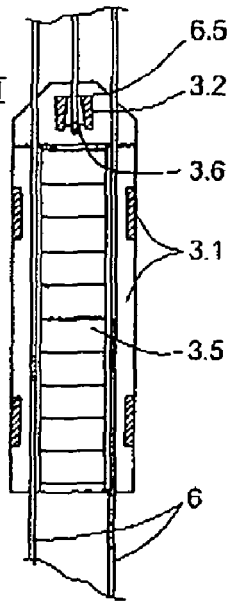
FIG. 2 is a plan view of the counterweight of the elevator according to FIG. 1.
Figure 1:
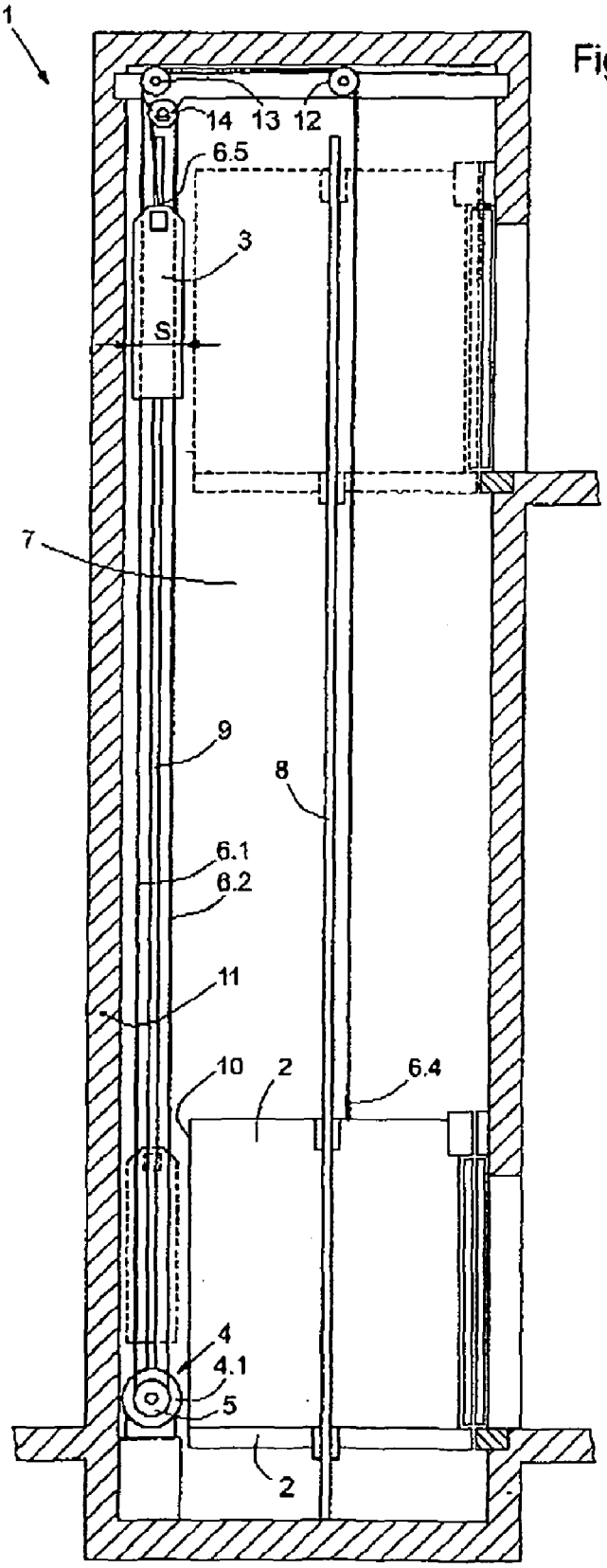
FIG. 1 is a schematic vertical section through an elevator with an elevator car, a counterweight arranged on the rear side of the elevator car and a drive unit disposed at the bottom, wherein the elevator support means forms a 1:1 suspension and two of its runs are led through the counterweight.

FIG. 1 shows a vertical section through an elevator 1, which comprises an elevator car 2, a counterweight 3, a drive unit 4 with a drive pulley 5 and at least one flexible elevator support means 6 (FIG. 2). The elevator 1 is installed in an elevator shaft 7, wherein the elevator car 2 is guided at car guide rails 8 and movable along a vertical car travel path. The counterweight 3 is guided at counterweight guide rails 9 and movable along a counterweight guide path arranged near the car travel path, i.e. between a rear side 10 of the elevator car 2 and a shaft wall 11 opposite thereto.

The elevator car 2 and the counterweight 3 are supported and driven by the at least one elevator support means 6, wherein they are so coupled together by the elevator support means that they move in opposite sense over respectively identical travel paths when the elevator support means is driven by the drive pulley 5 of the drive unit 4. The support means arrangement shown in FIG. 1 is a so-termed 1:1 suspension in which the part of the support means running over the drive pulley is moved just as fast as the elevator car. The at least one car support means 6 is fastened to a support means fixing point 6.4 of the elevator car 2 by its first end. From this fastening point it extends vertically upwardly to a first deflecting pulley 12 arranged in the region of the shaft head, from this horizontally to a second deflecting pulley 13, subsequently downwardly to the drive pulley 5 of the drive unit 4 disposed at the bottom, loops around this by 180°, then extends upwardly to a third deflecting pulley 14 mounted in the shaft head region, loops around this by 180° and then runs downwardly to the counterweight 3, to which it is fastened by its second end 6.5.

Advantageously use is made, as the elevator support means 6, of a tension means which is like a flat belt and which by comparison with usually employed steel cables is particularly capable of bending and is well-suited for space-saving arrangement as an elevator support means in combination with small drive and deflecting pulleys. However, steel wire cables preferably having a diameter of eight millimeters or less can also be used. As apparent from FIG. 1, all axes of the drive and deflecting pulleys of the elevator drive are oriented parallelly to the shaft wall at the counterweight side, wherein the center pulley planes of all drive and deflecting pulleys respectively associated with one elevator support means lie in the same plane. Such a support means arrangement is advantageous with respect to a long service life for all usual kinds of elevator support means. In the case of use of flat-belt-like elevator support means this arrangement is virtually obligatory, since the deflection thereof into other planes in the case of several mutually parallelly extending elevator support means cannot, in practice, be realized.

The arrangement of the elevator support means shown in FIG. 1 and described in the foregoing additionally has the advantage that the drive pulley 5, the deflecting pulleys 12, 13 and 14 and the support means fixing points 6.4 and 6.5 are so arranged that the elevator support means is always bent in the same sense (same side facing) about the drive and deflecting pulleys. An alternate loading of the elevator support means in bending is thereby avoided, which has a very positive effect on the service life thereof.

The drive unit 4 is arranged below the counterweight 3 disposed in its lowermost position and entirely in the shaft space lying between the car wall 10 at the counterweight side and the shaft wall 11 at the counterweight side and, in fact, so that at least the lower part of the elevator car 2 can move laterally past the drive unit 4. In order to keep the spacing between the car wall 10 at the counterweight side and the shaft wall 11 at the counterweight side as small as possible and the useful area of the elevator car 2 as large as possible the drive unit 4 is constructed to be narrow in the direction of a thickness S of the counterweight. In the form of embodiment of the elevator 1 shown in FIG. 1 the drive unit 4 comprises an electric motor 4.1, the drive pulley 5 fixed on a shaft of the electric motor 4.1 and a drive brake (not illustrated). The drive pulley 5 of the drive unit 4 has a smallest possible diameter, depending on the kind and load-bearing capability of the elevator support means 6, so that the required motor torque and thus the constructional size of the electric motor 4.1 can be kept as small as possible. Advantageously the electric motor 4.1 is executed as a permanent magnet motor, whereby for a given torque the required installation space thereof can be further reduced by comparison with usually employed asynchronous or synchronous three-phase motors. The diameter of the drive pulley 5, which advantageously is between 100 millimeters and 70 millimeters, is smaller than the thickness of the counterweight 3 measured at right angles to the shaft wall 11 at the counterweight side. In order to be able to realize the support means arrangement described in the foregoing the two runs 6.1, 6.2 of the elevator support means 6 leading to the drive pulley are led through cut-outs in the counterweight 3. This solution has the advantage that on the one hand an optimally small diameter of the drive pulley can be selected and that on the other hand the spacing between the elevator car 2 and the shaft wall 11 at the counterweight side only has to be dimensioned for the thickness S of the counterweight 3 and not additionally for a respective one of the support means with the requisite safety spacings on either side of the thickness of the counterweight.

Figure 3:
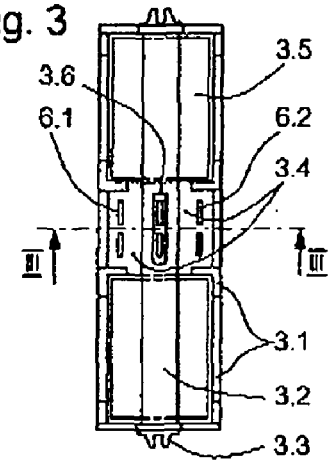
FIG. 3 is a vertical cross-section through the counterweight according to FIG. 2.

FIGS. 2 and 3 show to enlarged scale a vertical cross-section III-III through the counterweight 3 and a plan view of the counterweight of the elevator according to FIG. 1. This counterweight 3 comprises a support frame 3.1 of steel profile members with an upper support yoke 3.2 and two laterally mounted counterweight guide shoes 3.3. Present in the center of the support frame are vertically continuous cut-outs 3.4 through which the two runs 6.1, 6.2, which lead to the drive pulley 5, of the elevator support means 6 are led. Weight plates 3.5 are placed on both sides of the cut-outs 3.4 in the correspondingly formed support frame and fixed therein. The support yoke 3.2 contains a fastening device 3.6 for fastening the two ends 6.5 of the support means.

Figure 4:
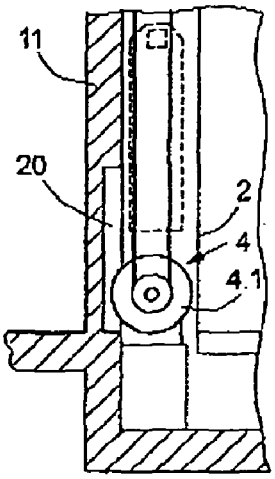
FIG. 4 shows a variant embodiment of the elevator according to FIG. 1, in which the drive unit protrudes into a niche of the shaft wall.

FIG. 4 shows a variant of the elevator according to FIG. 1 in which the drive unit 4 demands more space in the direction of the thickness S of the counterweight 3 than the counterweight itself. In order that, nevertheless, a largest possible useful area of the elevator car 2 can be achieved a niche 20 accepting a part of the drive unit 4 is present in the shaft wall 11 at the counterweight side. Insofar as the space adjoining the said shaft wall 11 allows this, the niche 20 can be executed as a continuous maintenance opening in the shaft wall 11 and provided with a closable maintenance door. Advantageously, maintenance and checking operations on the drive unit 4 disposed at the bottom can be carried out via this maintenance opening.

FIGS. 5 and 6 show a further form of embodiment of an elevator 101 according to the present invention, wherein FIG. 6 illustrates a horizontal section at the point V-V through the elevator. In this elevator two runs 106.1, 106.2, which lead to a drive pulley 105 of a drive unit 104, of an elevator support means 106 are similarly led through a cut-out 103.4 in a counterweight 103. By contrast to the elevator 1 illustrated in FIG. 1 the elevator 101 shown here has a so-termed 2:1 suspension for an elevator car 102 and the counterweight 103, in which the part of the elevator support means running over the drive pulley moves twice as fast as the elevator car and the counterweight. The two strands 106.6, 106.7 of the elevator support means 106 arranged parallel to one another carry the elevator car 102 in the form of an under-looping of deflecting pulleys 115 at the elevator car and the counterweight 103 by way of a deflecting pulley 116 at the counterweight. In this support means arrangement, as well, the axes of all drive and deflecting pulleys 105, 112 through 116 lie parallel to a shaft wall 111 at the counterweight side, the center planes of all drive and deflecting pulleys 105, 112 through 116 associated with a respective strand (106.6, 106.7) of the elevator support means 106 lie in the same vertical plane and the drive pulley 105, the at least one deflecting pulley 112 through 114 and support means fixing points 106.4, 106.5, which are present, are so arranged that the elevator support means is always bent in the same sense (same side facing) when running around the drive and deflecting pulleys. In addition, in the form of embodiment illustrated in FIGS. 5 and 6 the drive unit 104 is arranged below the counterweight 103 disposed in its lowermost position and completely in the shaft space lying between a car wall 110 at the counterweight side and the shaft wall 111 at the counterweight side. However, a part of the drive unit 104 could obviously here protrude into a niche of the shaft wall 111 at the counterweight side. A maintenance opening present in the shaft wall 111 is shown in FIG. 6 in the region of the drive unit 104 and is provided with a closable maintenance door. All advantages already stated in connection with the elevator 1 according to FIG. 1 are also present in the form of embodiment according to FIGS. 5 and 6.

It is also illustrated in FIGS. 5 and 6 how a largest possible useful area of the elevator car 102 can be achieved in an elevator in which the counterweight is arranged on a side of the elevator car which is also opposite a car guide rail 108. The car guide rails 108 and associated guide shoes 120 at the elevator car 102 are arranged diagonally with respect to the elevator car so that no car guide rail is disposed in the region between the elevator car 102 and the counterweight 103. Moreover, since the runs 106.1, 106.2, which lead to the drive pulley 105 of the drive unit 104, of the elevator support means 106 are led through the cut-out 103.4 in the counterweight 103, the counterweight 103 can be placed with a minimum spacing from the car wall at the counterweight side, which spacing is just sufficient to lead a vertical run 106.3 of the elevator support means 106 through between the car wall 110 at the counterweight side and the counterweight in the region of the car under-looping.

FIG. 7 shows the elevator support means 6, 106 of a flat belt kind which is particularly suitable for use in an elevator according to the present invention. This support means has the form of a wedge-ribbed belt which comprises a casing, which is reinforced by tensile strands 6.9, 106.9, of rubber or of a resilient synthetic material with wedge-shaped guide ribs 6.10, 106.10 formed in the material in its longitudinal direction. These wedge-shaped guide ribs have wedge angles β of 60° to 120° and co-operate with grooves, which are of complementary construction at least in part, in the drive and deflecting pulleys so that the elevator support means 6, 106 is guided on these. This elevator support means is suitable for co-operating with drive and deflecting pulleys having outer diameters of less than 100 millimeters.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator without an engine room has an elevator car movable along a car travel path and a counterweight movable along a counterweight travel path arranged near the car travel path, a drive unit provided with at least one drive pulley and arranged below the counterweight disposed in its lowermost position and the drive unit mounted at a bottom of a shaft below the counterweight travel path, at least one elevator support means, which is guided over the drive pulley and at least one deflecting pulley present in a shaft head region, wherein the support means supports the elevator car and the counterweight and moves the elevator car and the counter weight in opposite directions when the support means is driven by the drive pulley of the drive unit, comprising:

the counterweight having a cut-out formed therein and extending vertically through the counterweight between a top end and a bottom end of the counterweight; and a pair of runs of the support means, which lead to the drive pulley, extend through said cut-out in the counterweight, each run of said pair of runs entering one of said top end and said bottom end and exiting another one of said top end and said bottom end of the counterweight.

2. The elevator according claim 1 wherein the elevator support means is a flat belt.

3. The elevator according to claim 2 wherein the elevator support means has guide ribs, which are oriented in a longitudinal direction and which co-operate with guide grooves of at least one of the drive pulley and the at least one deflecting pulley.

4. The elevator according to claim 1 wherein the counterweight includes a support frame.

5. The elevator according to claim 4, wherein the counterweight includes profile members on both sides of the cut-out.

6. The elevator according to claim 3, wherein weight plates are placed in the support frame on both sides of the cut-out.

7. The elevator according to claim 4, wherein the cut-out through which the two runs are led is formed through a center of the support frame.

8. The elevator according to claim 4 wherein the support frame is made of profile members with an upper support yoke and fastening devices for fastening the ends of the support means, the fastening device arranged on the upper support yoke.

9. The elevator according to claim 4 wherein the support frame is made of profile members with an upper support yoke, and deflecting pulleys for deflecting the support means are arranged on the upper support yoke.

10. The elevator according to claim 1 wherein the drive unit is arranged below the counterweight in the lowermost position thereof so that the elevator car can move past the drive unit.

11. The elevator according to claim 1 wherein an axis of the drive pulley and also an axis of the at least one deflecting pulley are arranged parallel to a shaft wall of the elevator wherein the counterweight travel path is positioned between the car travel path and said shaft wall.

12. The elevator according to claim 1 wherein the support means has two strands, and drive and deflecting pulleys each associated with a respective one of said strands are all arranged in a common plane.

13. The elevator according to claim 1 wherein the elevator support means has one pulley engaging surface and the drive pulley, the at least one deflecting pulley and support means fixing points which are present are so arranged that the elevator support means is always bent when running around the drive pulley and the at least one deflecting pulley with the one pulley engaging surface facing the drive pulley and the at least one deflecting pulley.

14. The elevator according to claim 1 wherein the elevator support means, the drive pulley, the at least one deflecting pulley and other deflecting pulleys form a 1:1 suspension or a 2:1 suspension for the elevator car and the counterweight.

15. The elevator according to claim 1 wherein at least one of the drive pulley and the at least one deflecting pulley has an outer diameter of less than 100 millimeters.

16. The elevator according to claim 1 wherein an axis of the drive pulley is arranged at right angles to a shaft wall of the elevator at a counterweight side.

17. The elevator according to claim 1 wherein the drive unit is arranged entirely in a shaft space lying between a car wall at a counterweight side and a shaft wall of the elevator at the counterweight side.

18. The elevator according to claim 1 wherein a part of the drive unit protrudes into a niche in a shaft wall of the elevator at a counterweight side.

19. The elevator according to claim 1 wherein the drive unit comprises a permanent magnet motor.

20. An elevator without an engine room has an elevator car movable along a car travel path and a counterweight movable along a counterweight travel path arranged near the car travel path, a drive unit provided with at least one drive pulley and arranged below the counterweight disposed in its lowermost position, at least one elevator support means, which is guided over the drive pulley and at least one deflecting pulley present in a shaft head region, wherein the support means supports the elevator car and the counterweight and moves the elevator car and the counter weight in opposite directions when the support means is driven by the drive pulley of the drive unit, comprising:

the counterweight having a cut-out formed therein and extending vertically through the counterweight between a top end and a bottom end of the counterweight, and a pair of runs of the support means, which lead to the drive pulley, extend through said cut-out in the counterweight, each run of said pair of runs entering one of said top end and said bottom end and exiting another one of said top end and said bottom end wherein a part of the drive unit protrudes into a niche in a shaft wall of the elevator at a counterweight side, and wherein the shaft wall at the counterweight side has in a region of the drive unit a maintenance opening which is closable by a maintenance door and which enables at least maintenance of the drive unit from a space lying outside the elevator shaft.

* * * * *